United States Patent [19]

Hannah

[11] 4,080,248

[45] Mar. 21, 1978

[54] TWO-STAGE OXYGEN PULPING

[75] Inventor: Mark Andrew Hannah, Vancouver, Wash.

[73] Assignee: Crown Zellerbach Corporation, San Francisco, Calif.

[21] Appl. No.: 700,247

[22] Filed: Jun. 28, 1976

[51] Int. Cl.[2] ..... D21C 3/26

[52] U.S. Cl. ..... 162/38; 162/65; 162/90

[58] Field of Search ..... 162/19, 38, 65, 90, 162/39

[56] References Cited

U.S. PATENT DOCUMENTS

| | | | |
|---|---|---|---|
| 2,147,618 | 2/1939 | Rawling | 162/65 |
| 3,024,158 | 3/1962 | Grangaard et al. | 162/65 |
| 3,764,464 | 10/1973 | Samuelson | 162/65 |
| 3,843,473 | 10/1974 | Samuelson et al. | 162/65 |
| 3,944,463 | 3/1976 | Samuelson et al. | 162/65 |

*Primary Examiner*—Arthur L. Corbin

*Attorney, Agent, or Firm*—Stanley M. Teigland; Corwin R. Horton

[57] ABSTRACT

The pulping of lignocellulosic material in the presence of oxygen gas and an alkaline liquid is improved by carrying out the process in two stages. In the first stage, the alkaline liquid is trickled over the material as the oxygen is passed up through the material. In the second stage, the material is submerged in oxygenated alkaline liquid which flows through the material.

7 Claims, No Drawings

TWO-STAGE OXYGEN PULPING

It is known that lignocellulosic material can be pulped in an aqueous alkaline medium using an oxygen-containing gas. This invention provides an improvement in the oxygen pulping process. The improvement comprises carrying out the process in two stages. In the first stage the lignocellulosic material is contacted with a stream of oxygen-containing gas while an aqueous alkaline liquid is trickled over the material. In the second stage, the material produced in the first stage is submerged in oxygenated aqueous alkaline liquid which flows through the material.

In accordance with this invention, the lignocellulosic material to be pulped is charged to a digester, such as one conventionally employed for oxygen pulping. An aqueous alkaline liquid is continuously fed to the top of the digester and allowed to trickle down over the lignocellulosic material. As used herein, the term "trickle" refers to a flow of the alkaline liquid which is sufficient to wet substantially all the lignocellulosic material, but which is less than that at which the material is submerged in the liquid, so that the interstices between particles of the lignocellulosic material are occupied principally by a gas phase, rather than a liquid phase, even in the absence of a flow of a gas through the material.

The rate of flow of the alkaline liquid through the digester is preferably between about 500 and 2500 liters per minute per square meter of digester cross section.

As the alkaline liquid is trickled over the material, an oxygen-containing gas is continuously fed to the digester, preferably at the bottom, so that the gas rises and flows countercurrent to the flow of the alkaline liquid. The gas preferably contains at least 50, more preferably at least 70, volume percent oxygen on a dry gas basis (i.e. the gas may also be saturated with water vapor). The other component of the gas would be principally carbon dioxide if the gas is recycled. The rate of flow of the oxygen is preferably between about 80 and 140 cubic meters (standard temperature and pressure) per hour per square meter of digester cross section. The partial pressure of the oxygen in the digester is preferably between about 5 and 25, more preferably between 10 and 20, atmospheres.

In order to provide efficient contact between the lignocellulosic material and the oxygen, the material charged to the reactor is preferably in a form which exposes as much surface area as possible for contact with the oxygen without impeding the flow of the oxygen. For example, when the lignocellulosic material is wood, the wood is preferably in the form of chips having a thickness between about one and two mm. Other lignocellulosic material which may be pulped includes straw, bagasse, bamboo, hemp, and the like. In general, the thickness of the lignocellulosic material is preferably less than two mm.

If desired, before being charged to the digester, the lignocellulosic material may be pretreated, such as with caustic solution, in accordance with methods known in the art in connection with oxygen pulping.

The pH of the alkaline liquid in the digester is preferably maintained between 7 and 9. However, the pH of the liquid fed to the digester may be above 9, inasmuch as the pH of the liquid is rapidly lowered by contact with carbon dioxide and acidic reaction products generated in the digester. The pH of the liquid in the digester may be monitored by measuring the pH of the liquid leaving the digester, as it is essentially the same.

The pH of the liquid in the digester may be maintained in the desired range by recycling the liquid and adding to it new liquid (referred to herein as injection liquid) having a higher pH. To accommodate the injection liquid and to maintain a constant ratio of liquid to lignocellulosic material, spent liquid is preferably bled off upstream from the addition of the injection liquid at the same rate as the injection liquid is added. Alternatively, a surge tank may be interposed in the recycle loop.

The alkaline liquid is prepared by dissolving a base in water. Any base can be used which will neutralize the oxidation products and maintain a pH between 7 and 9 in the digester. The base is preferably an alkali metal carbonate or bicarbonate or combination thereof. The alkali metal is preferably sodium.

The total amount of base employed depends on the amount of lignocellulosic material charged to the reactor since the base is neutralized by carbon dioxide and other acidic compounds generated by the pulping reaction. When the base is sodium carbonate or sodium bicarbonate and the lignocellulosic material is wood, the amount of base employed, calculated as $Na_2O$, based on the amount of wood is normally in the range of 10 to 30 weight percent.

Recycle of the alkaline liquid facilitates control not only of the pH of the liquid, but also of the temperature of the liquid. The temperature of the liquid in the digester is preferably between 140° and 160° C. Because the pulping reaction is exothermic, the temperature of the liquid fed to the digester is lower, preferably between 130° and 150° C depending on the circulation rate. Generally, this means that after start-up the liquid must be cooled in its transit through the recycle loop outside the digester.

If desired, the spent aqueous alkaline liquid may be fed to a recovery unit wherein organic compounds in the liquid are oxidized to carbon dioxide and water, and the residual liquid is recycled to the digester. Such recovery units are known in the art, being disclosed for example in U.S. Pat. No. 3,654,070. The gas phase withdrawn from the digester may also be fed to the recovery unit to provide the oxygen necessary to oxidize the organic compounds, although it would probably be more economical to recycle the gas to the digester after removing at least some of the carbon dioxide from it.

The first stage of the process of this invention is carried out until the yield of the partially pulped material is between 70 and 85%. This yield corresponds to a residence time of the lignocellulosic material in the digester of usually between about one and three hours, more usually between 1.5 and 2 hours. When the indicated yield has been obtained, further pulping is carried out in the second stage with the material submerged in the alkaline liquid.

The process conditions in the second stage are generally in accordance with the same parameters as outlined supra for the first stage, except that the flow of alkaline liquid in the digester may be in any direction, and the introduction of oxygen gas directly into the digester is optional, although it is essential that the alkaline liquid be oxygenated by contact with oxygen gas. Oxygenation of the alkaline liquid may be effected by passing oxygen through the digester as in the first stage, or, preferably, by contacting the alkaline liquid with oxygen gas in a separate oxygenator prior to introducing it into the digester. Of course both methods may be employed, but in any event, the alkaline liquid in the digester is preferably substantially saturated with oxygen. The oxygeneator may be an in-line mixer or a device in which oxygen is bubbled through the liquid and/or the liquid is sprayed through oxygen. The oxygen fed to the oxygenator may conveniently also be the oxygen fed to the digester in the first or second stage. The liquid fed to the digester in the first stage may also be oxygenated if desired, but there would be no substantial benefit in doing so since the liquid is readily saturated with oxygen by contact with the oxygen in the digester.

The flow of the alkaline liquid in the digester in the second stage may be up, down or, preferably, radial. Radial flow may be effected by introducing the liquid into the digester from a manifold in the center of the digester and discharging it from ports along the side of the digester. Since the flow is not necessarily normal to the cross section of the digester, it is better to express the specific flow rate on the basis of the volume of the digester, rather than on the cross sectional area as in the case of the first stage. The flow rate in the second stage is preferably 0.02 to 0.3, more preferably 0.1 to 0.2, liter per minute per liter of digester volume.

The second stage is carried out until a lignin content is reached which is conventional for the desired application of the pulp, which corresponds to a residence time in the reactor of usually between about 3 and 8 hours, more usually between 6 and 7 hours. With the use of catalysts, however, the reaction time may be shortened to as little as 2 to 3 hours. Upon completion of the second stage, the pulp is screened and washed in accordance with conventional methods for recovering chemical pulps. The liquid effluent from the screening and washing steps may be fed to the recovery unit (if employed) for recycle to the reactor.

After being recovered, the pulp may be subjected to further treatment, such as bleaching and drying, in accordance with conventional methods.

The process of this invention may be carried out as a continuous process or as a batch process. In a continuous process, the material is fed continuously to the top of the reactor and is withdrawn continuously at the bottom. In either type of process, the second stage may be carried out either in the same digester employed in the first stage or in a second digester.

Compared to processes in which the pulping is carried out entirely in a submerged phase, the process of this invention provides several advantages, primarily due to more efficient transfer of oxygen to the lignocellulosic material during the pulping reaction. In particular, the more efficient transfer of oxygen results in more uniform pulping, as reflected in a final product having a lower proportion of rejects (incompletely pulped material). The process also results in a shorter overall reaction time.

It would be impractical to carry out the pulping process on a commercial scale entirely in the manner prescribed for the first stage because after a yield of about 70% is obtained, the flow of oxygen through the material ceases to be uniform if the uninterrupted height of the material is more than about five meters. By employing a tray reactor, the effective height of the material may be reduced to a level where the pulping process can be carried out entirely in the first stage, but the use of such a reactor would add significantly to the capital and operating cost of the process.

Compounds which promote or catalyze oxygen pulping, and compounds which protect carbohydrates from degradation during oxygen pulping, may be employed in the process if desired.

EXAMPLE

First Stage

A digester having a capacity of about 110 liters and a cross sectional area of 820 square centimeters was charged with five kilograms (oven dry weight) of alder chips. An aqueous alkaline liquid was trickled over the chips as oxygen was passed upward through the chips. The liquid was prepared by dissolving sodium bicarbonate in water. The initial concentration of the sodium bicarbonate in the liquid, calculated as $Na_2O$, was 7.69 grams per liter. The pH of the liquid fed to the digester was 8.1. The weight of the liquid was 32.5 kilograms. The spent liquid was recycled to the digester, with injection liquid being added to the recycle stream to maintain an average pH of 7.5 in the reactor. Spent liquid was bled from the recycle stream at the same rate at which the injection liquid was added. A total of 24 kilograms of injection liquid was added. The injection liquid had a pH of 8.35 and a concentration of sodium bicarbonate, calculated as $Na_2O$, of 9.94 grams per liter. The circulation rate of the alkaline liquid was maintained between 35 and 55 liters per minute. The oxygen flow rate was 9.5 liters (standard temperature and pressure) per minute. The pressure in the reactor was 16 kg/sq. cm. The temperature in the digester was 140° C. After two hours, the partially pulped material was recovered at a yeild of 85%.

The run was repeated, except the initial alkaline liquid had a weight of 35 kilograms, a concentration of sodium bicarbonate, calculated as $Na_2O$, of 7.14 grams per liter, and a pH of 8.4, and the average pH of the liquid in the reactor was 8.1.

Second Stage

The partially pulped material from both runs was combined and charged to the digester. The material was submerged in an alkaline liquid having an initial pH of 8.0 and a concentration of sodium bicarbonate, calculated as $Na_2O$, of 9.34 grams per liter. The weight of the liquid was 64 kilograms. The composition of the injection liquid was the same as in the first stage. A total of 64 kilograms of injection liquid were added to maintain an average pH of 7.6. The circulation rate of the liquid was 15 liters per minute. The oxygen flow rate and the temperature and pressure in the reactor were the same as in the first stage. After five hours, a pulp was obtained at an overall yield of 54.9%, which included 1.8% (based on original wood) of rejects. The pulp had a Permanganate number of 9.5, a viscosity (TAPPI Standard T-230 SU-66) of 76 centipoise, and a brightness (TAPPI Standard T-217 M-48) of 58.3. The pulp was suitable for making paper.

I claim:

1. In the process of pulping lignocellulosic material in a digester in the presence of an aqueous alkaline liquid and oxygen gas, the improvement comprising carrying out the process in two stages, the first stage being a gaseous phase and the second stage being a submerged phase, the first stage comprising continuously trickling the alkaline liquid down over the material as the oxygen gas is continuously passed up through the material, the first stage being carried out until the yield of the material is between 70 and 85%, the second stage comprising submerging the material produced in the first stage in oxygenated alkaline liquid and continuously flowing the alkaline liquid through the material, the second stage being carried out until a pulp suitable for making paper is obtained, the pH of the alkaline liquid in both stages being between 7 and 9.

2. The process of claim 1 wherein the rate of flow of the alkaline liquid in the first stage is between about 500 and 2500 liters per minute per square meter of digester cross section, and the rate of flow of the alkaline liquid in the second stage is between 0.02 and 0.3 liter per minute per liter of digester volume.

3. The process of claim 1 wherein the rate of flow of oxygen gas in the first stage is between about 80 and 140 cubic meters (measured at standard temperature and pressure) per hour per square meter of digester cross section.

4. The process of claim 1 wherein the alkaline liquid in the second stage is oxygenated by contact with oxygen gas prior to being introduced into the digester.

5. The process of claim 1 wherein the alkaline liquid is an aqueous solution of an alkali metal bicarbonate or carbonate or mixture thereof.

6. The process of claim 1 wherein spent alkaline liquid is recycled to the digester, and alkaline liquid having a higher pH is added to the recycle stream to maintain the pH of the alkaline liquid in the recycle stream between 7 and 9.

7. The process of claim 1 wherein the temperature of the alkaline liquid in the digester is between 140° and 160° C and the partial pressure of oxygen in the digester in the first stage is between 5 and 25 atmospheres.

* * * * *